United States Patent [19]

Baatz et al.

[11] 4,445,042

[45] Apr. 24, 1984

[54] RADIATION-SHIELDING TRANSPORT AND STORAGE CONTAINER

[75] Inventors: Henning Baatz; Dieter Rittscher, both of Essen, Fed. Rep. of Germany

[73] Assignee: GNS Gesellschaft für Nuklear-Service mbH, Fed. Rep. of Germany

[21] Appl. No.: 243,562

[22] Filed: Mar. 13, 1981

Related U.S. Application Data

[63] Continuation-in-part of Ser. No. 120,108, Feb. 8, 1980, Pat. No. 4,274,007.

[30] Foreign Application Priority Data

Mar. 19, 1980 [DE] Fed. Rep. of Germany ..... 3010518

[51] Int. Cl.[3] ..... G21F 5/00

[52] U.S. Cl. ..... 250/506.1; 376/272

[58] Field of Search ..... 250/506; 376/272; 252/478

[56] References Cited

U.S. PATENT DOCUMENTS 3,982,134 9/1976 Housholder et al. ..... 250/506.1

4,197,467 4/1980 Williams ..... 250/506.1

*Primary Examiner*—Bruce C. Anderson

*Attorney, Agent, or Firm*—Karl F. Ross; Herbert Dubno

[57] ABSTRACT

A safety container for the disposal of radioactive wastes has a plug-type cover received in a complementary seat and having cylindrical and tapered (frustoconical) fitting parts sealed against the seat by elastic seals in part. This cover is over-lain by a safety cover engaging a corresponding portion of the vessel via a metal-to-metal seal while a further control cover is provided above the latter with a metallic or elastomeric seal. The covers define two control spaces from which fluid can be tapped to ascertain the effectiveness of the respective seals.

4 Claims, 8 Drawing Figures

RADIATION-SHIELDING TRANSPORT AND STORAGE CONTAINER

CROSS REFERENCE TO RELATED APPLICATIONS

The present application is a continuation-in-part of application Ser. No. 120,108 filed Feb. 8, 1980 (U.S. Pat. No. 4,274,007 issued June 16, 1981) and relating, in turn, to our copending application Ser. No. 966,951 filed Dec. 6, 1978 (U.S. Pat. No. 4,278,892 issued July 14, 1981) and making reference to then pending applications Ser. No. 940,856 of Sept. 8, 1978 (U.S. Pat. No. 4,272,683), Ser. No. 940,098 (now U.S. Pat. No. 4,234,798), and Ser. No. 107,276 of Sept. 26, 1979 (U.S. Pat. No. 4,288,698 of Sept. 8, 1981). Reference may also be had to U.S. Pat. Nos. 4,229,316 and 4,235,739 issued on still earlier applications commonly owned herewith.

For the construction of the vessel and as to radiation-shielding properties thereof and the use of such vessels, these prior art applications and patents are hereby incorporated by reference in their entirety and it is noted that the prior art known to applicants to be the most relevant is the art of record in said applications.

FIELD OF THE INVENTION

As is pointed out in the aforementioned copending applications, it is known to provide for the transport and storage of radioactive wastes, containers or vessels of a radiation-shielding material and which may be provided with channels or compartments to contain radiation-blocking or radiation-attenuating materials, and with ribs or the like to promote heat exchange with ambient air. Radioactive material can be placed in the containers and sealed by cover arrangements of which the most pertinent is that found in the parent application. It is there pointed out that an effective closure for the vessel can be provided by forming the mouth of the vessel with a seat receiving a plug-type inner cover having a frustoconical portion and a cylindrical portion fitting into correspondingly shaped parts of the seat and sealed relative to the latter with elastomeric seals, generally O-rings. Above this inner cover an outer cover was provided which extended beyond the outline of the inner cover and was secured to the vessel.

In this application it was also noted that the packaging of the radioactive material in the container involved the inclusion of a control gas which could be monitored to verify the security of the seal and any failures thereof readily determined.

In this prior construction, the control spaced, i.e. the space from which the control gas was tapped to verify seal effectiveness, was the gap provided between the plug-type inner cover and the seat of the vessel and between the seals.

While this system was found to be highly effective, it did not satisfy all transport and storage requirements, especially those in which the container was subjected to rigorous handling or exceptionally long-term storage or both.

OBJECTS OF THE INVENTION

It is the principal object of the present invention to provide an improved transport and storage container for radioactive wastes which extends the principles of application Ser. No. 120,108 but yet provides additional security for long-term storage and transport.

Another object of the invention is to provide a container for the purposes described which facilitates monitoring of the security thereof.

Still another object of the invention is to provide an improved cover arrangement for a storage vessel for radioactive materials.

SUMMARY OF THE INVENTION

These objects and others which will become apparent hereinafter are attained with a radiation-shielding vessel adapted to receive radioactive wastes and comprising an upwardly open container whose wall thickness and structure is sufficient to effect at least an attenuation in radiation transmission and which comprises a seat at its mouth for a plug-type radiation-obstructing cover which can be of the type described in our copending application Ser. No. 120,108.

More particularly, this cover, referred to as the inner or first cover, can comprise a frustoconical portion lying inwardly of a flange formed with a cylindrical portion, these portions being juxtaposed with corresponding reshaped seat portions of the container mouth and being sealed with respective sealing rings relative to the seat portions.

According to the present invention, this inner cover is used in combination with an intermediate or second cover and with an outer or third cover so that the second or safety cover defines a control space or compartment with and above the first or shielding cover and is, in turn, disposed below the outer control compartment or space therewith. Thus, according to the invention, there is a further control compartment above the second or safety cover.

The sealing device between the shielding-cover flange and the wall of the seat portion of the vessel and the sealing arrangement between the second or safety cover spaced thereabove and the vessel are, according to the present invention, metal seals, i.e. direct metal-to-metal bonds or metal-to-metal contacts via metal sealing rings. The sealing arrangement between the control cover and the vessel body can be formed either as an elastically deformable or as a metal seal, or both.

The spacing of the covers to define the respective control compartments can be relatively small so that the compartments are narrow.

According to the preferred embodiment of the invention, the safety cover is provided with a closable aperture to which can be connected a monitoring device for the gases in the control department therebelow. Such devices are described in our application Ser. No. 120,108.

A closable aperture can also be provided for connecting a monitoring device of this type to the outer or control cover for communication with the control compartment therebelow.

The monitoring device can be a simple manometer responsive to the pressure in the compartment which generally would be modified if there was leakage from the interior of the vessel of the control gas which is sealed therein under pressure. The monitoring devices can also include devices capable of analysing the gas in the control compartments.

According to another aspect of the invention, the elastically deformable seals can be comprised of O-rings of rubber or synthetic resin material and the metal seals can be formed by the direct welding of lips together and/or by soldering or by metal O-rings.

Tests have shown that the additional cover, i.e. the control cover, improves the security of the vessel during transport and storage, even to the effect of permitting the container to drive from heights of 9 meters and above without damage to the seals.

When the elastic seals are affected by the handling of the container, the metal seals remain intact and the elastic seals are capable of absorbing those which might rupture the metal seals. Thus, the combination provides an effective sealing of the interior under practically all conditions at least in part because of the damping effect allowed by the seal combination.

Another advantage of the system of the invention is that it is advantageous for long-term storage in which case the metallic seal between the inner or shielding cover flange and its seat plays a significant role as the first barrier to escape which, although not readily repairable should leakage be detected in a control compartment there beyond, nevertheless provides a degree of security which is enhanced by the presence of at least one metal seal outwardly thereof.

In general the outer or control cover can be moved to enable repair of the sealing to the safety cover when necessary. The sealing can be effected by resoldering, rewelding or any other convenient technique without material danger of escape of the stored radioactive materials.

BRIEF DESCRIPTION OF THE DRAWING

The above and other objects, features and advantages of the invention will become more readily apparent from the following description, reference being made to the accompanying drawing in which.

SPECIFIC DESCRIPTION

Figure 3:
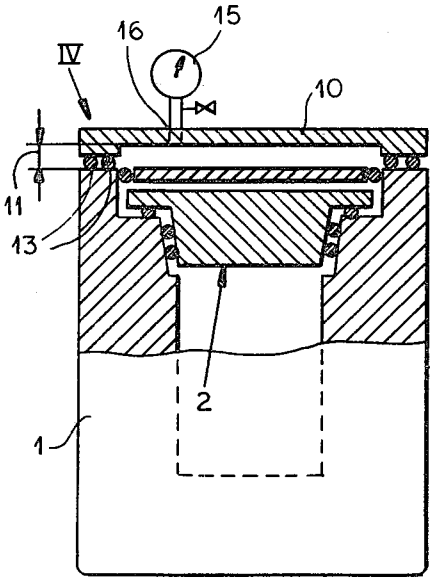
FIG. 3 is a similar view showing the application of the outer or control cover.

The container of the present invention provide radiation-shielding storage of radioactive materials especially illuminated nuclear reactor fuel elements and basically comprise and upwardly open vessel 1 whose wall thickness is dimensioned to block substantially all escape of radiation through the vessel walls and will depend upon radiation energy of the stored materials.

A plug-shaped shielding cover 2 fits into the vessel 1 and is of a corresponding thickness, i.e. provides the basic protection against radiation energy escaped from the interior of the vessel. Above this cover is provided the second or safer cover 3 and sealing devices 4 and 5 are provided between the shielding cover and a correspondingly shaped seat of the vessel 1. The shielding cover 2 has a flange 6 and a cylindrical or conical fitting portion 7 which is received in the correspondingly shaped seat 8 of the mouth of the vessel while the safety cover 3 is spaced above the flange.

The seals 4 are elastic O-ring seals between the frustoconical portion 7 and the seat 8 while the seal 5 represents a metal seal, i.e. a metal ring in the embodiments illustrated in FIGS. 1 through 4.

The cover 3, according to the invention, is spaced above the cover 2 so as to define a control compartment therewith while a control cover 10 is spaced above cover 3 to define a further control compartment 11 above the latter.

The spacings 9 and 11 are shown disproportionately large in the drawing for the sake of clarity and it will be understood that these compartments may be simply narrow gaps.

Figure 4:
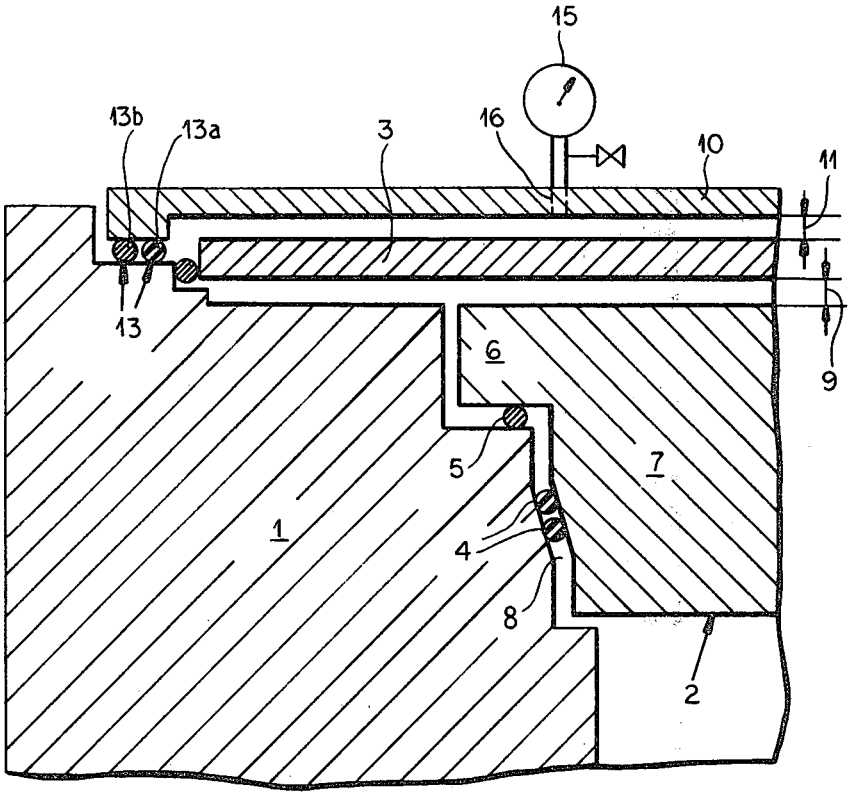
FIG. 4 is a detail view through the region of a container differing somewhat from that of FIG. 2 but corresponding to the portion IV thereof.
Figure 7:
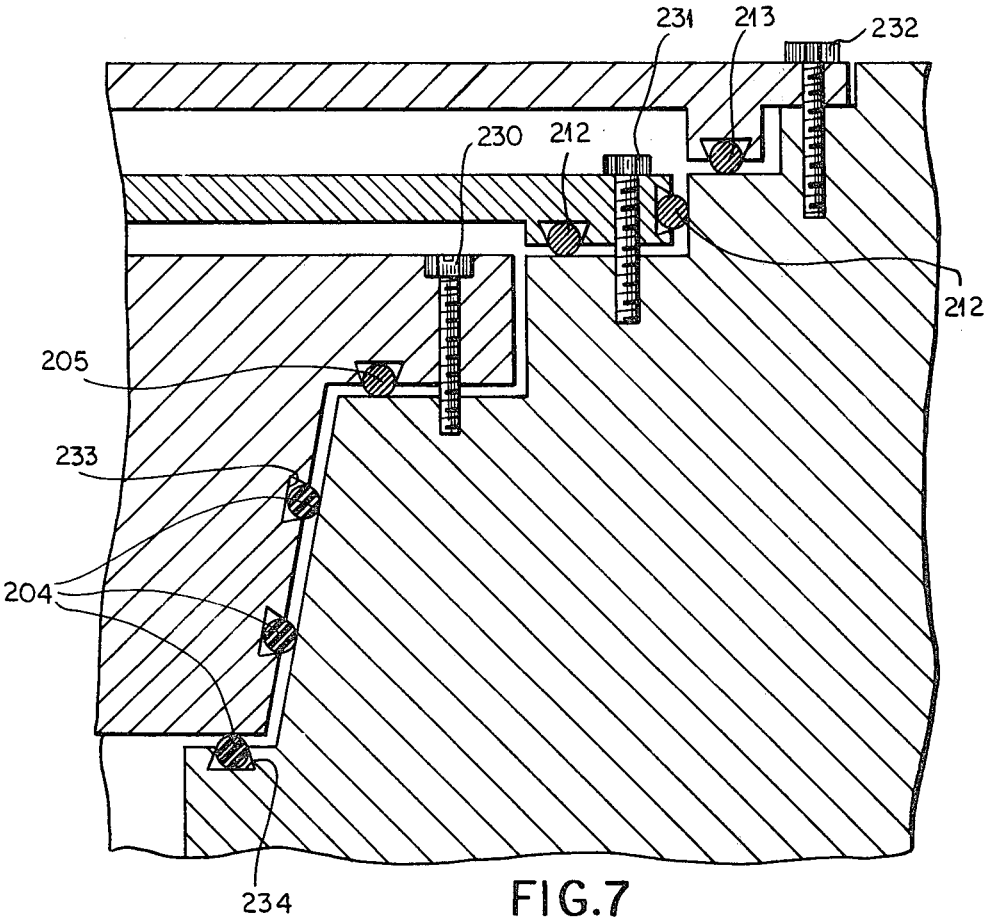
FIG. 7 is a section showing still another embodiment of the invention.
Figure 8:
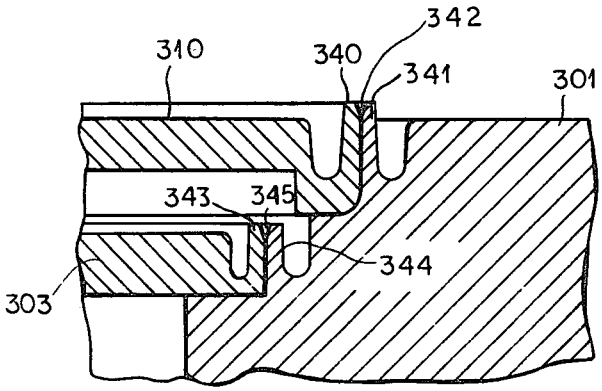
FIG. 8 is a detailed view providing still another illustration of the principles of the invention.

According to the invention, moreover, the seal 12 between the cover 3 and the vessel 1 can be a metal-to-metal seal, i.e. can be formed by a metal ring as illustrated in FIG. 4 and held in place by bolts (FIG. 7) or can be a welded lip seal (FIG. 8).

Figure 2:
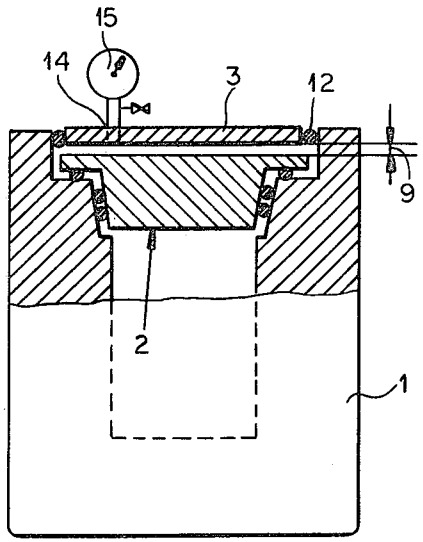
FIG. 2 is a view similar to FIG. 1 showing the application of the safety or second cover.
Figure 1:
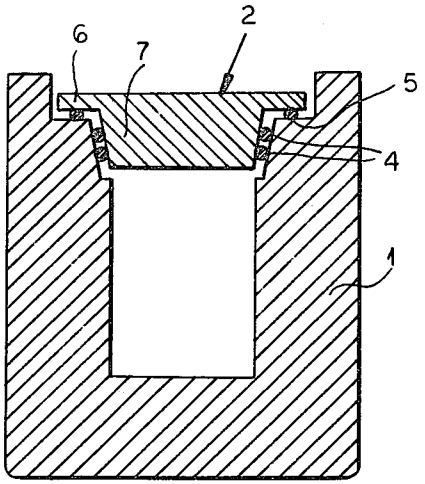
FIG. 1 is a vertical section diagrammatically illustrating a storage vessel in accordance with the invention after insertion of the inner or shielding cover.

The seal 13 between the control cover 10 and the vessel is shown as an elastic seal in FIGS. 1 through 3 but can comprise both an elastic O-ring 13*a* (FIG. 4) and a metal ring 13*b*.

The safety cover 3 is formed with a closable opening 14 for connection of a monitoring device 15 which communicates with the compartment 9. Similarly the cover 10 has a closable opening 16 for connection of a monitoring device 17 communicating with the compartment 11 above the cover 3. The monitoring device can be located in the space 9 below the cover 3 or in a recess in cover 2 so that only an electrical cable, for example, need be led out.

As a comparison of FIGS. 1 through 4 will show, it is possible to use part or all of the system of the invention as the occasion requires. For example, when the unit is to be transported only the shielding cover 2 need be applied (FIG. 1) and when radioactive material is to be stored for short periods or for long periods without mechanical disturbance of the unit, the safety cover 3 can be applied. When, however, long-term storage and severe mechanical handling stresses are contemplated, the control cover 10 is applied. During storage the compartments 9 and 11 can be monitored as described in Ser. No. 120,108 to ensure safety of the seal. Naturally, should incipient failure of the seal be observed by monitoring of compartment 9, the safety cover 10 can be applied at any time.

Figure 5:
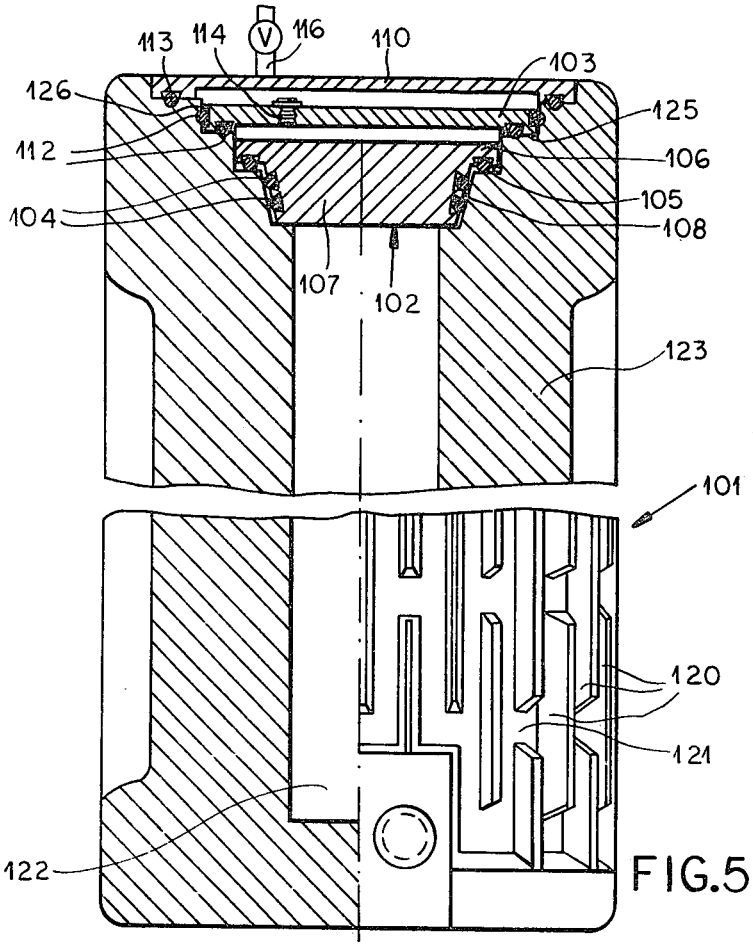
FIG. 5 is an axial section partly in elevational view, illustrating yet another embodiment of a container according to the invention
Figure 6:
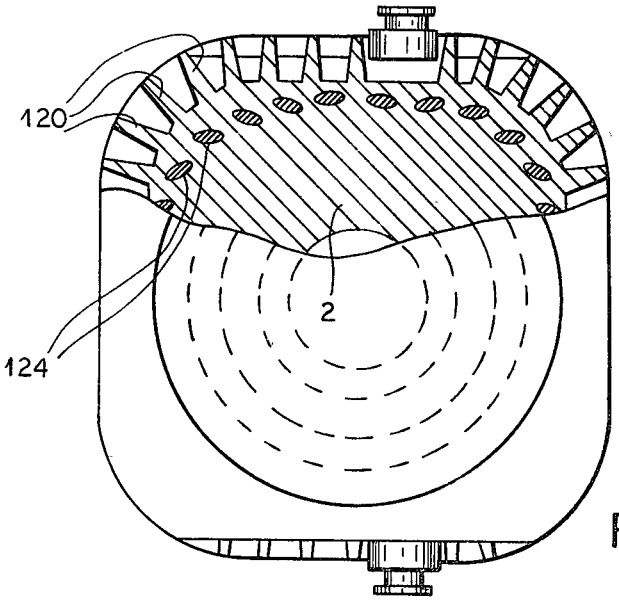
FIG. 6 is a plan view thereof partly broken away.

FIG. 5 shows the structure of the container 101 in greater detail, the container having cooling tubes 120 which are interrupted by space 121 to permit heat exchange with ambient air and hence dissipation of the heat resulting from radioactive decay within the compartment 122 of the vessel 101. In this embodiment the frustoconical or plug portion 107 of the cover 102 is sealed by rubber O-rings 104 against the frustoconical seat 108 while the flange 106 rests upon the metal seal 105. The wall thickness of the vessel wall 123 can be dimensioned to completely block passage of radiation from the interior of the vessel or such wall can be formed with axially extending channels 124 which are filled with a radiation-shielding material, i.e. a material which has a high neutron or gamma cross section.

The seals 112 between the safety cover 103 and the shoulder 125 of the cylindrical wall 126 of the recess in which this cover is received, can be metal rings and a further metal ring seal 113 can be provided between the outer cover 110 and the vessel 101. The outer cover 110 lies flush with the top of the container. The cover 103 is formed with a removable plug 114 for connection to the monitoring device while the closable apertures 116 of cover 110 can be provided with a valve as shown.

As can be seen from FIG. 7 the covers may be held in place by bolts 230, 231 and 232 while the O-rings 204 which are elastomeric and the metal rings 203, 212 and 213 are received in respective grooves 233 in the cover or grooves 234 in the vessel wall.

Metal-to-metal seals can also be provided by welding as shown in FIG. 8. Here the outer cover 310 and the vessel 301 are formed with parallel lips 340 and 341 which are welded together at a seam 342. Similarly, the saftey cover 303 can have a lip 343 which is juxtaposed with a lip 344 of the vessel 301, these lips being welded at 345. A similar weld-lip seal can be provided for the flange of the shielding cover as well.

We claim:

1. A transport-storage container for radioactive materials, comprising:

a radiation-shielding vessel open at the end thereof and adapted to receive said material;

a plug-type radiation-shielding cover received in said open end and having a block-forming portion juxtaposed with a complementary seat portion of said vessel and a flange portion extending outwardly beyond said block portion;

elastically deformable first seal means between said plug portion and said seat portion for obstructing escape from the interior of said vessel;

second seal means forming a metal seal between said flange portion and said vessel;

a safety cover spaced above said radiation-shielding cover to define the first control compartment therewith;

third seal means forming a metal seal between said vessel and said safety cover, said third seal means including adjacent annular lips of said vessel and said safety cover, and a weld seam bridging said lips;

a control cover spaced above said safety cover to define a second control compartment therewith; and fourth seal means sealing said control cover to said vessel, said fourth seal means comprises a lip formed on said control cover and a lip formed on said vessel and a weld seam joining said lips of said fourth seal means.

2. The container defined in claim 1, further comprising means forming a closable aperture in said safety cover communicating with said first compartment for connection to a monitoring device.

3. The container defined in claim 1, further comprising means forming a closable aperture in said control cover communicating with said second compartment for connecting said second compartment with a monitoring device.

4. The container defined in claim 1 wherein said second seal means is a metal-to-metal seal.

* * * * *